United States Patent [19]

Onishi et al.

[11] Patent Number: 4,605,926

[45] Date of Patent: Aug. 12, 1986

[54] ILLEGAL-SHEET-MATERIAL DETECTION APPARATUS IN SHEET MATERIAL MANUFACTURING MACHINE

[75] Inventors: Tetsuo Onishi; Yoshihide Sugiyama, Wakayama, both of Japan

[73] Assignees: Duplo Seiko Corp.; Duplo Manufacturing Corp., both of Japan

[21] Appl. No.: 417,601

[22] Filed: Sep. 13, 1982

[51] Int. Cl.[4] ..... H04Q 9/00; B65H 7/12; G08B 21/00

[52] U.S. Cl. ..... 340/825.3; 340/674; 271/263

[58] Field of Search ..... 340/825.3, 674, 673, 340/675; 271/259, 263

[56] References Cited

U.S. PATENT DOCUMENTS

| | | | |
|---|---|---|---|
| 4,112,379 | 9/1978 | Schmidt | 340/673 |
| 4,160,546 | 7/1979 | McMillan et al. | 271/263 |
| 4,243,216 | 1/1981 | Mazumder | 340/674 |
| 4,275,879 | 6/1981 | Yamashita et al. | 340/674 |
| 4,428,041 | 1/1984 | Honkawa | 340/675 |
| 4,462,587 | 7/1984 | Graef et al. | 271/263 |

*Primary Examiner*—Donald J. Yusko
*Attorney, Agent, or Firm*—Jackson & Jones

[57] ABSTRACT

An illegal-sheet-material detecting apparatus, which is adapted to detect whether the property of each of the passing sheet materials is legal or not in a sheet manufacturing machine, provided with a comparison circuit for detecting the lag of the same detection value of the n th+ first sheet material with respect to the detection value showing the property such as thickness, size or the like of the optional portion of the n th sheet material memorized in the memory circuit as an electric signal. When the lag detected by the comparison circuit has exceeded a predetermined range, the counting operation of the sheet material is caused to stop thereby to use the detection value of the n th sheet material as a reference value for comparing it with the n th+ first sheet detection value.

14 Claims, 48 Drawing Figures

ILLEGAL-SHEET-MATERIAL DETECTION APPARATUS IN SHEET MATERIAL MANUFACTURING MACHINE

BACKGROUND OF THE INVENTION

1. Field of the Invention

The present invention relates to an illegal-sheet-material detecting apparatus, which is adapted to detect whether the property of each of the passing sheet materials is legal or not in a sheet manufacturing machine, which places a plurality of sheet materials, each having almost the same property i.e. the presence, etc. of shape, size and printing, such as bill, ballot ticket for election, etc. at intervals for each of the single sheet materials to sequentially pass them through a given position.

2. Description of the Prior Art

A conventional prior art illegal-sheet-material detection apparatus is shown in FIG. 1. In FIG. 1 light-emitting elements 1*a* and 1*b* are disposed, respectively, opposite to light-receiving elements 2*a* and 2*b*. A sheet material 3 is passed, between them, in the direction of an arrow by a proper means in a known manner. The output signals of the light-receiving elements 2*a* and 2*b* at that time are amplified respectively by amplification circuits 4 and 5. Thereafter, the outputs of the amplification circuits 4 and 5 are inputted to a counting circuit 6 which counts the number of the sheet materials 3 and displays the count on a display means 7. The outputs of the amplification circuits 4 and 5 are inputted to a double-feed detection circuit 8 of such character as shown in FIG. 2, to a length-illegality detection circuit 9 of such character as shown in FIG. 3 and to a half-ticket detection circuit 10. When each of these circuits has detected the double feed of the sheet material 3, the length illegality caused due to chain feed, etc., or the half-ticket condition caused due to broken or folded sheet materials, by then the output of the amplification circuit 4 or the amplification circuit 5, a driving circuit 12 causes any additional feeding of the sheet material 3 to stop.

An operation switch 13 outputs, to the control circuit 11, command signals such as start, stop, etc. for the count sheet-number of the sheet materials 3, the count operation.

As shown in FIG. 2, the double-feed detection circuit 8 is provided with a reference voltage producing circuit 21 for setting a reference voltage to be outputted by manual adjustment, a comparison circuit 22 for outputting a signal having a pulse width, which is equal to a period of time during which the size of the difference, with respect to the reference voltage, of the output signal of the amplification circuit 4 becomes larger than the predetermined value, a comparison circuit 23 for outputting the same signal as described hereinabove by the size of the difference, with respect to the reference voltage, of the output signal of the amplification circuit 5, a pulse-width discrimination circuit 24 for discriminating the pulse width of the output signal of the comparison circuits 22, 23. When the double feed of the sheet materials 3 is caused, the time taken for the output signal of the amplification circuit 4 or 5 to exceed the range of the lag with respect to the reference voltage, to be outputted from the reference voltage producing circuit 21 determined by the manual adjustment, becomes longer than the predetermined time. The double-feed detection circuit uses this fact to output the double feed signal from the pulse-width discriminating circuit 24.

As shown in FIG. 3, the length-illegality detection circuit 9 is provided with a passage deciding circuit 25 for deciding whether or not the sheet material 3 has passed between light-emitting elements 1*a*, 1*b* and light-receiving elements 2*a*, 2*b*, a long-limit timer circuit 26 and a short-limit timer circuit 27 for manually setting the top limit value and the bottom limit value of the time required for the sheet material 3 to pass between the light-emitting elements 1*a*, 1*b* and the light receiving elements 2*a*, 2*b* a comparison circuit 28 for deciding whether or not the output time of the passage deciding circuit 25 stays between the top limit value and the bottom limit value. When the illegal length is caused by the chain feed, break or the like of the sheet materials 3, the output time of the output signal from the passage deciding circuit 25 becomes larger than the top limit value or smaller than the bottom value. The length-illegality detection circuit uses this fact to output the length-illegality signal from the comparison circuit 28.

However, when the double-feed detection circuit 8 and the length-illegality detection circuit 9 have been constructed, respectively, as shown in FIG. 2 and FIG. 3, the manual adjustment of the reference-voltage producing circuit 21, the long-limit timer circuit 26 and the shortlimit timer circuit 27 is required to be performed again everytime the thickness and size of the sheet material 3 vary. In addition, the double-feed deciding circuit 8 takes its error action due to the drifts, etc. of the light-emitting elements 1*a*, 1*b*, the light-receiving elements 2*a*, 2*b* and the amplification circuits 4, 5. The length-illegality detection circuit 9 takes its error action due to changes in the feed speed of the sheet material 3.

Also, to remove the above problems, expensive components, which are less in drift with respect to temperature, time lapse, are required to be used for the light-emitting elements 1*a*, 1*b*, the light-receiving elements 2*a*, 2*b* and the amplification circuits 4, 5, thus resulting in higher cost.

SUMMARY OF THE INVENTION

Accordingly, an essential object of the present invention is to provide an illegal-sheet material detection apparatus in a sheet-material manufacturing machine, which can eliminate the disadvantages inherent to the above conventional apparatus, which is applied to the counting apparatus of the sheet material or the progressive apparatus of the sheet materials, and which can positively detect the illegal sheet materials being slipped out of a standard value in thickness or size.

Another object of the present invention is to provide an illegal-sheet material detection apparatus in a sheet-material manufacturing machine, which can operate regardless of the variations in the feed speed of the sheet materials, the drifts of a comparison circuit for detecting the lag of the sheet materials or the like, and which is superior in operational property and low in cost.

According to the present invention, there is provided an illegal-sheet-material detection apparatus in a sheet material manufacturing machine which places a plurality of sheet materials, each having approximately the same property, at intervals for each of the single sheet materials thereby to sequentially pass them through a given position, characterized in that a property detection circuit for detecting the property of an optional portion of each of said sheet materials as an electric signal at said given position, and a memory circuit for memorizing the output signal of said property detecting circuit are provided. A comparison circuit for detecting the difference of the detection value of the n th+ first sheet with respect to the detection value of the sheet material of the n th (n is an integer of 1 or more) memorized in said memory circuit is provided to output an illegality detection signal from said comparison circuit when said difference has exceeded the predetermined range. When the lag detected by the comparison circuit has exceeded a predetermined range, the counting operation of the sheet materials is caused to stop thereby to use the detection value of the n th sheet material as a reference value for comparing it with the n th+ first sheet detection value. The illegal-sheet material detection apparatus in a sheet-material manufacturing machine is applied to the counting apparatus of the sheet materials or the progressive apparatus of the sheet materials so that the illegal sheet materials, which vary from a standard value in thickness or size may be positively detected with superior operation and low cost.

BRIEF DESCRIPTION OF THE DRAWINGS

These and other objects, features, aspects and advantages of the present invention will become more apparent from the following detailed description when taken in conjunction with the accompanying drawings, in which.

DESCRIPTION OF THE PREFERRED EMBODIMENTS

Before proceeding with the description, it is to be noted that, throughout the several attached drawings, like numbers refer to like parts.

Figure 1:
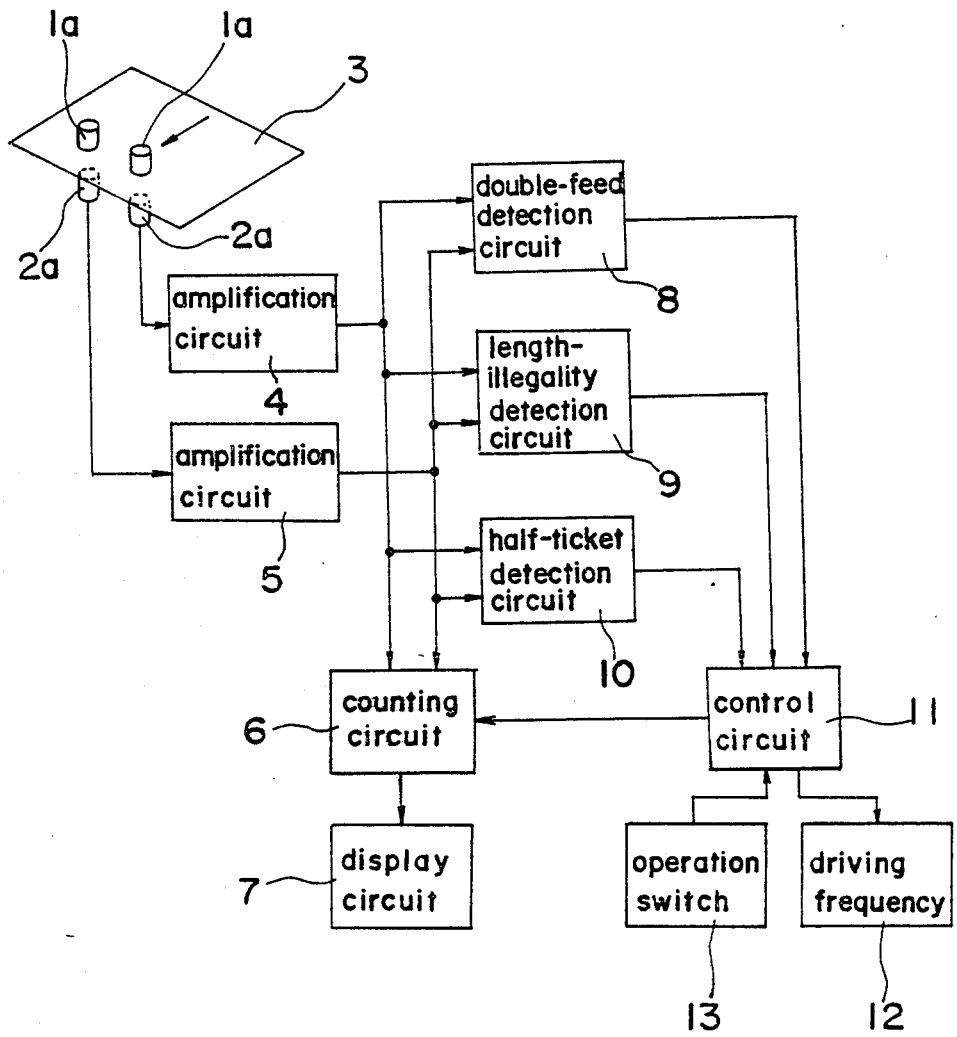
FIG. 1 is a block diagram of a counting apparatus of the conventional sheet material, as referred above.
Figure 2:
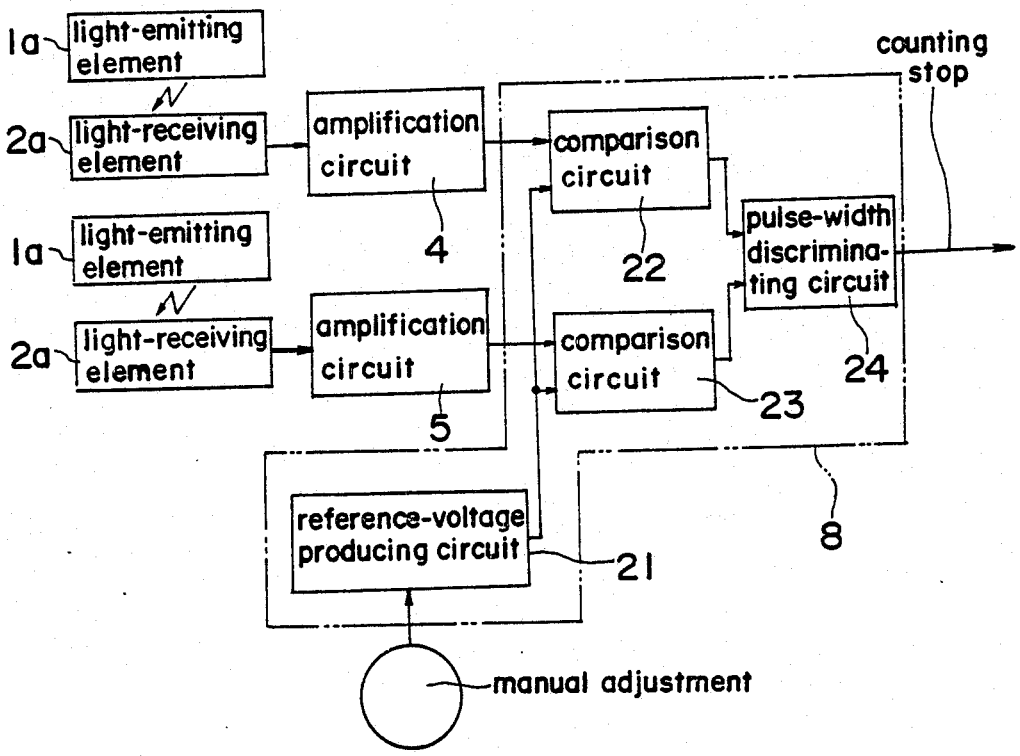
FIG. 2 is a block diagram of a double-feed detection circuit of FIG. 1.
Figure 3:
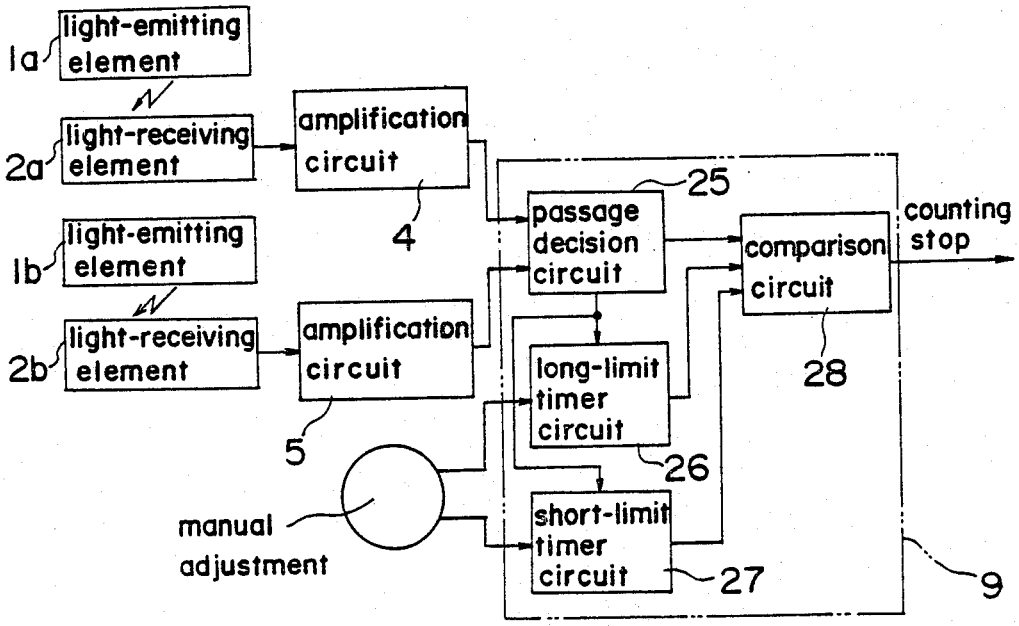
FIG. 3 is a block diagram of a length-illegality detection circuit of FIG. 1.
Figure 4A:
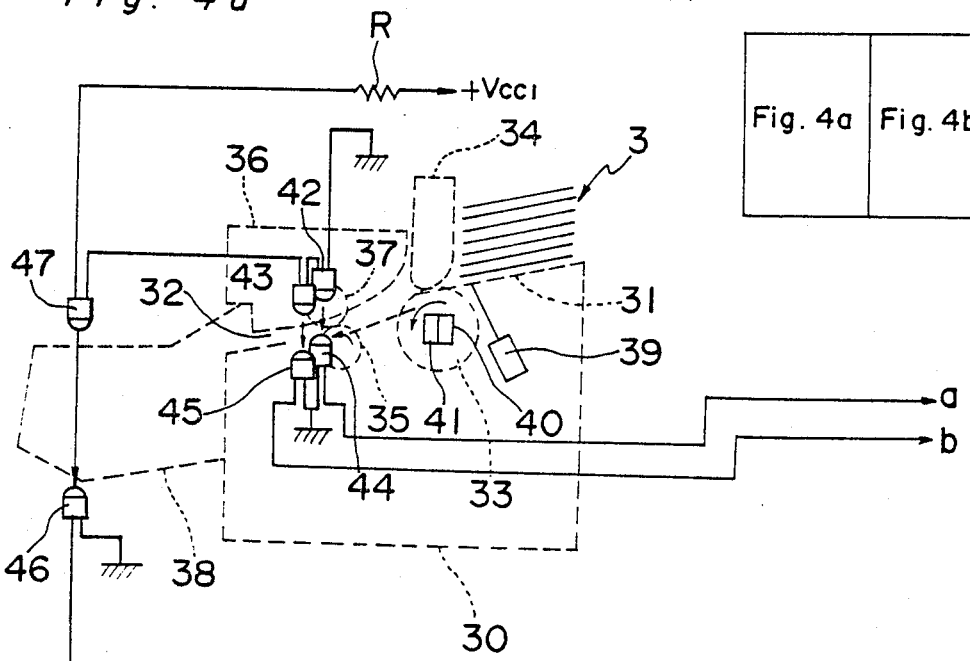
FIG. 4, 4*a* and 4*b* are block diagrams of a counting apparatus of the sheet material in accordance with the present invention.
Figure 4:
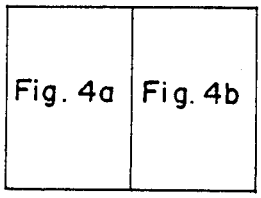
Figure 4:
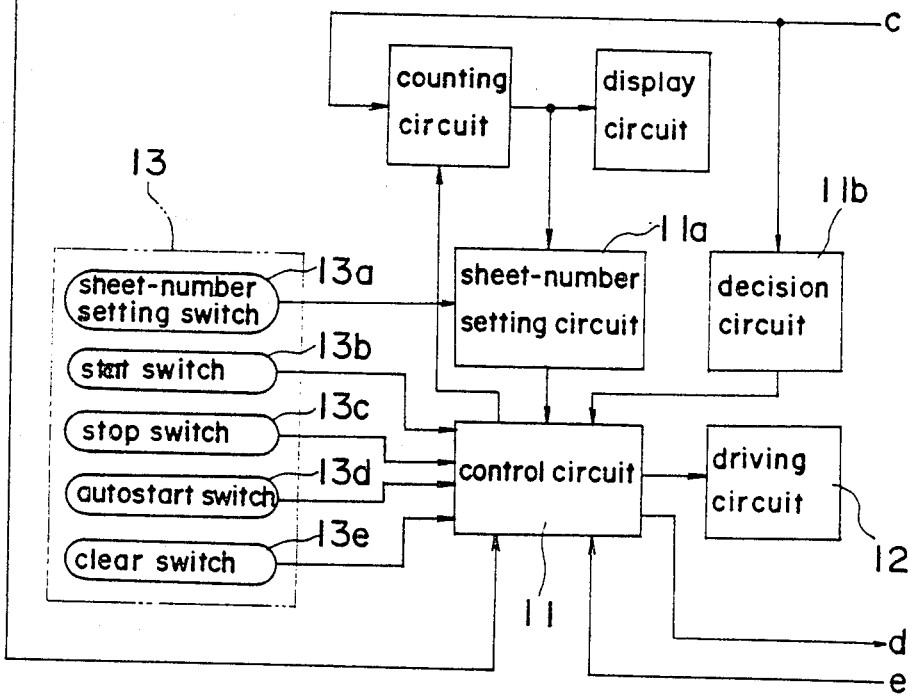
Figure 4B:
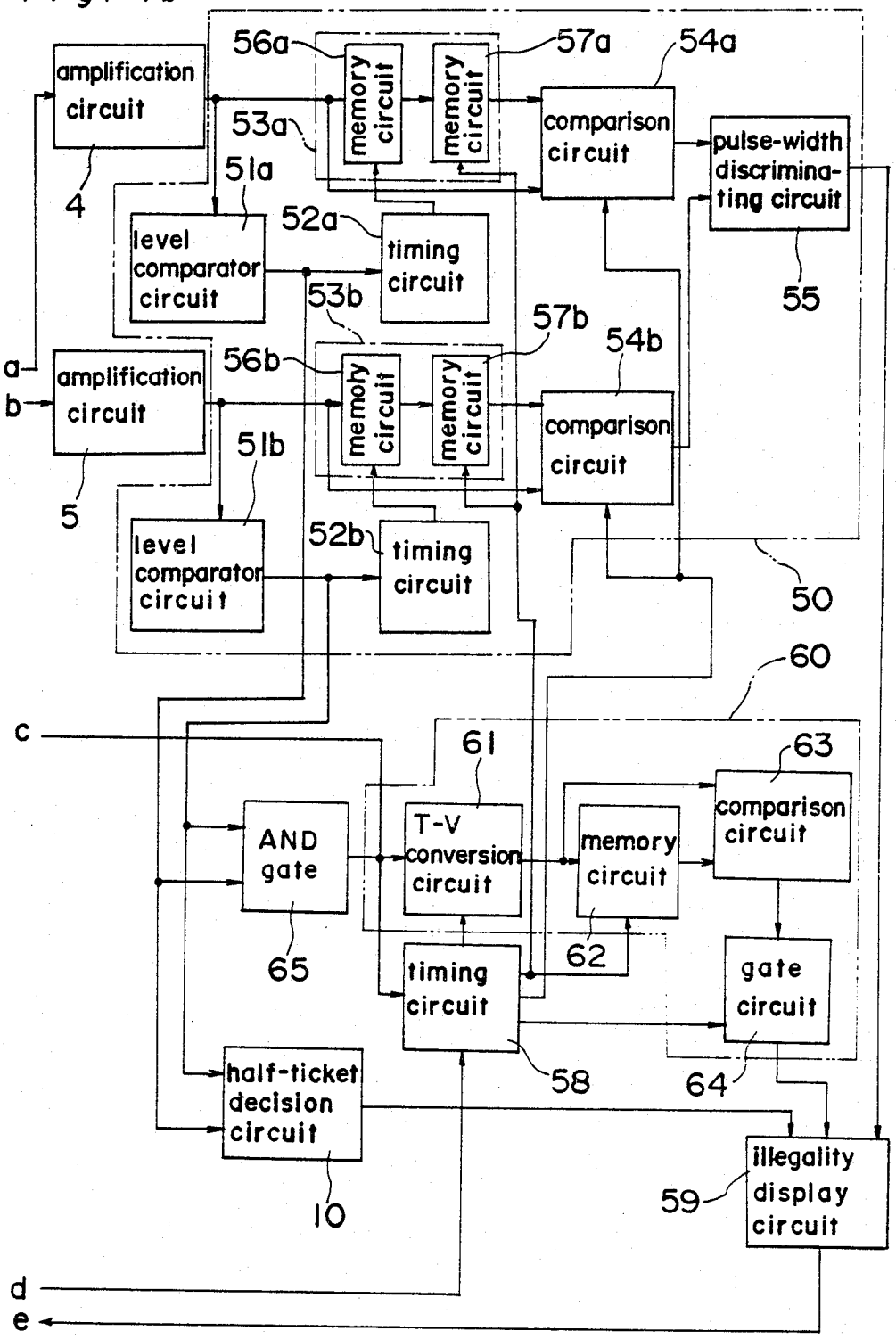

Referring to FIG. 4, there is provided a supply portion 31 for the sheet materials 3 in the upper portion of the feed mechanism 30. A passage 32 for the sheet materials 3 is provided, which leads from the supply portion 31 to one side face of the feed mechanism 30.

A rubber roller 33, which is made of natural rubber or the like, is disposed between the supply portion 31 and the passage 32. A friction member 34 is provided, which comes into pressure contact, at its one end, against the peripheral face of the rubber roller 33. The rubber roller 33 is rotated in the direction of the arrow so that the sheet materials 3 of the supply portion 31 may be delivered to the passage 32 one by one from the bottom of supply portion 31 at approximate given intervals in a known manner.

The friction member 34 is made of a material such as polyurethane or the like, wherein the friction coefficient of the friction member with respect to the sheet material 3 is smaller than that of the rubber roller 33 with respect to the sheet material 3, and the friction coefficient between the sheet materials 3 is large. Thus, the sheet material 3, placed on the lowermost sheet material 3, is prevented from being delivered together with the lowermost sheet material 3 to the passage 32. The sheet materials 3 of the supply portion 31 are adapted to be delivered sequentially from the lowermost sheet material 3 to the passage 32 one by one at approximate given intervals.

A feed roller 35 made of polyurethane is provided on the way to the passage 32. A control roller 37 made of aluminum is provided, which comes into pressure contact against the peripheral face of the feed roller 35 through the elastic force of a spring (not shown) mounted on a control member 36 and disposed within the control member 36. The sheet materials 3 are adapted to be delivered, by the feed roller 35 and the control roller 37, to a stacker portion 38 provided on one side portion of the feed mechanism 30 and are sequentially piled up thereon.

The speed of the sheet material 3 to be fed by the feed roller 35 is set to be higher than the delivering speed of the sheet material 3 by the rubber roller 33 so that a gap may be caused without fail between the n th (n is an integer of 1 or more) sheet material 3 and the n+1 sheet material passing through the passage 32.

In the feed mechanism 30, a solenoid 39 is adapted to increase the inclination of the supply portion 31 at the feed start of the sheet material 3 to cause one end of the lowermost sheet material 3 to come into contact against the rubber roller 33 thereby to cause the sheet material 3 to be interlocked between the rubber roller 33 and the control member 34. An electromagnetic clutch 40 connects a driving motor (not shown) with the rubber roller 33 and disconnects the driving motor from the rubber roller, while an electromagnetic brake 41 stops the rubber roller 33.

Two infrared-ray emitting diodes 42 and 43, with their lighting faces being downwardly directed, are disposed at the side of the control member 36 on the passage 32 of the feed mechanism 30 of such character as described hereinabove. Two photodiodes 44 and 45 are disposed on the side of the feed mechanism 30 so that the light receiving faces may oppositely face with lighting faces, respectively.

The infrared-ray emitting diodes 42 and 43, together with a light-emitting diode 47, are connected in series through a resistor R between ground and a power supply $Vcc_1$. The light-emitting diode is adapted to project the infrared ray to a phototransistor 46 to detect whether or not the sheet material 3 exists on the stacker portion 38 at the counting start of the sheet materials 3.

The outputs of the photodiodes 44 and 45 are inputted respectively to the amplification circuits 4 and The amplification circuits 4 and 5 convert into voltages the photocurrents which are outputted respectively from the photodiodes 44 and 45. Each of the amplification circuits 4 and 5 is composed of an arithmetic amplifier in a known construction.

The outputs of the amplification circuits 4 and 5 are outputted to a double-feed detecting circuit 50 to be described hereinafter.

The double-feed detection circuit 50 is composed of level comparators 51*a*, 51*b* timing circuits 52*a*, 52*b*, memory circuits 53*a*, 53*b*, comparison circuits 54*a*, 54*b*, and a pulse-width discrimination circuit 55.

The level comparator circuit 51*a* is of well known character, using the arithmetic amplifier, etc. The level comparator circuit shapes the signals to be inputted from the amplification circuit 4 to output them to the timing circuit 52*a*.

The timing circuit 52*a* is composed of one-shot circuit, which outputs the pulse of a given width such as 2 msec or so from a time when the signal is inputted from the amplification circuit 4. The output of the timing circuit 52*a* is outputted to the memory circuit 53*a*.

The memory circuit 53*a* is composed of two memory circuits 56*a*, 57*a* which are sample-hold circuits each being composed of a bilateral switch, a capacitor, a voltage follower, etc.

A signal, which changes in accordance with the degree the sheet materials 3 transmits the infrared ray, is inputted from the amplification circuit 4 to the memory circuit 56*a*, the sheet material being adapted to pass between the infrared-ray emitting diodes 42, 43 and the photodiodes 44, 45. The pulse, i.e., sample pulse, of a given width is inputted from the timing circuit 52*a*. The output of the amplification circuit 4 is adapted to be sample-held only for the inputting period of the sample pulse.

The output of the memory circuit 56*a* is inputted to the other memory circuit 57*a*. The memory circuit 57*a* is adapted to sample-hold the output of the memory circuit 56*a* by a sample pulse to be inputted from a timing circuit 58 to be described later.

The output of the memory circuit 57*a*, together with the output of the amplification circuit 4, is inputted to the comparison circuit 54*a*.

The comparison circuit 54*a* outputs an out-of-limits signal when the output of the amplification circuit 4 has varied out of a predetermined range with respect to the output of the memory circuit 57*a*; namely, the ratio therebetween has been exceeded a predetermined range. The output of the comparison circuit 54*a* is inputted to the pulse-width discrimination circuit 55.

The level comparator 51*b*, the timing circuit 52*b*, the memory circuit 53*b* composed of two memory circuits 56*b*, 57*b*, and the comparison circuit 54*b* are the same in construction as the circuits each having an accompanying letter to the same numeral in the above-description. The input signals and output signals of each circuit are, also, similar to those of the above-description. The outputs of the comparison circuit 54*b* are also outputted to the pulse-width discriminating circuit 55.

The pulse-width discrimination circuit 55 is composed of an integration circuit, a level detection circuit, etc. When the width of the pulse to be outputted from the comparison circuits 54*a* or 54*b* is larger than a predetermined value and when the output of the integration circuit has exceeded a predetermined value, the level detection circuit is reversed to output an illegal signal to an illegality display circuit composed of flip-flop, etc.

A length-illegality detection circuit 60 is composed of a time-voltage conversion circuit (hereinafter referred to as T-V conversion circuit), a memory circuit 62, a comparison circuit 63 and a gate circuit 64.

The T-V conversion circuit 61 is composed of an integration circuit, a bilateral switch, which turns on and off the input of the signal to the integration circuit, a bilateral switch, which discharges the integration capacitor of the integration circuit by a pulse signal to be inputted from the timing circuit 58, and so on. The output of an AND gate 65, which has, as inputs, the outputs of level comparators 51*a* and 51*b*, is integrated, during the time the sheet material 3 passes between the infrared-ray emitting diodes 42, 43 and the photodiodes 44, 45, thereby to output to the memory circuit 62 a signal proportional to the passing time of the sheet 3.

The memory circuit 62 is a sample-hold circuit, which has the same construction as that of the memory circuit 56*a* for the double-feed detecting circuit 50. The output of the memory circuit 62, together with the output of the T-V conversion circuit 61, is inputted to the comparison circuit 63.

The comparison circuit 63 is a circuit to detect the ratio of the output of the T-V conversion circuit 61 varies with respect to the output of the memory circuit 62. The output of the comparison circuit 63 is inputted to the gate circuit 64.

The gate circuit 64 opens by a timing pulse from the timing circuit 58 and inputs a signal, to be outputted from the comparison circuit 63, as an illegal length signal to an illegality display circuit 59 at a time when the sheet materials 3 has completed its passing at least between the infrared-ray emitting diode 42 and the photodiode 44 or between the infrared-ray emitting diode 42 and the photodiode 44 or between the infrared-ray emitting diode 43 and the photodiode 45.

A half-ticket signal, which shows that a sheet material 3 broken to half-tickets has passed the passage 32 of the feed mechanism 30, is inputted from a half-ticket decision circuit to be described hereinafter to the illegality display circuit 59. When a double-feed signal, a length-illegality signal or a half-ticket signal has been inputted, the illegality display circuit 59 lights a lamp or the like to display the passing of the double-feed of the sheet materials 3, the length illegality or the half ticket thereby to output the illegality signal to a control circuit 11.

The half-ticket decision circuit 10 is composed of a gate circuit, etc. with the outputs of level comparators 51*a* and 51*b* as inputs. A half-ticket signal is adapted to be outputted when the signal has been inputted, more than an optionally set time, only from the level comparator 51*a* or the level comparator 51*b*.

The output of an AND gate 65 with the outputs of the level comparators 51*a*, 51*b* as inputs is inputted to a counting circuit 6.

The counting circuit 6 and a display circuit 7 displaying the output of the counting circuit 6 are both known circuits. The counter circuit 6 maybe composed of, for example 3-carry decimal counter. The output of the counter circuit 6 is inputted to the display circuit 7, which is composed of 7-segment display elements with 7-segment decoder and light-emitting diode arranged in the shape of day, thereby to display the count value of the output pulse from the AND gate 65 counted by the counting circuit 6. The outputs of the counting circuit 6 are also inputted to the sheet-number setting circuit 11*a*.

The sheet-number setting circuit 11*a* is a digital comparator circuit. When the output signal of a sheet-number setting switch 13*a* provided on an operation switch 13 has coincided with the output signal of the counting circuit 6, the sheet-number setting circuit 11*a* is adapted to output a coincidence signal to a control circuit 11.

Signals are inputted to the control circuit 11 respectively from a sheet-number setting circuit 11*a*, a decision circuit 11b composed of a timer for outputting a signal showing that the sheet materials 3 have run out on the supply portion 31 for the sheet materials 3 with the output of the AND gate 65 as an input, an illegality display circuit 59, a phototransistor 46 and an operation switch 13. By these signals, the control circuit 11 controls a driving circuit 12 for driving the solenoid 39, the electromagnetic brake 40, the electromagnetic clutch 41, etc., in addition to the counting circuit 6, and further controls a timing circuit 58.

The operation switch 13 is composed of a sheet-number setting switch 13a, a start-switch 13b, a stop switch 13c, an automatic start switch 13d and a clear switch 13e.

Figure 5:
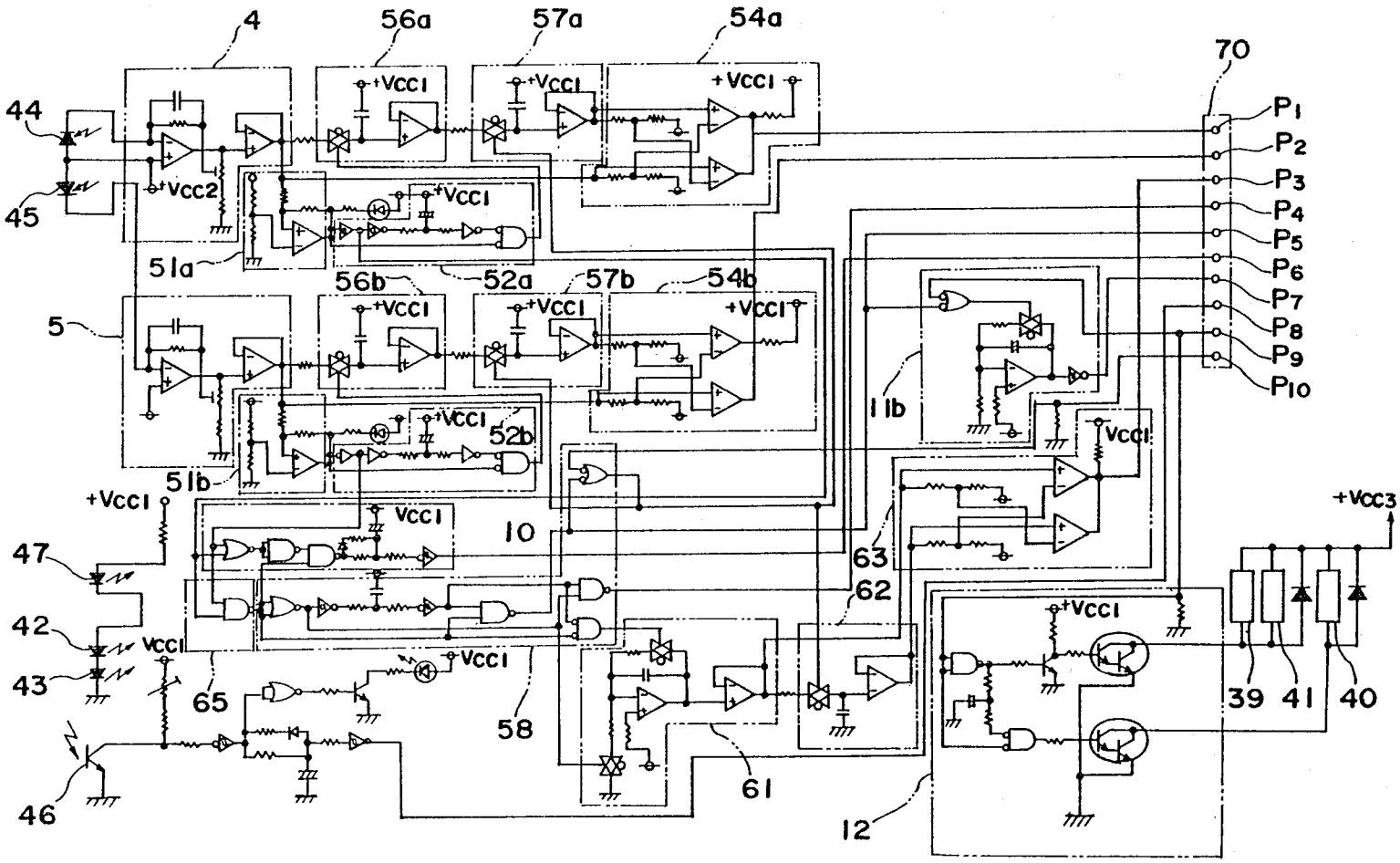
FIGS. 5 through 7 are circuit diagrams of portions of FIGS. 4, 4*a* and *b* respectively.
Figure 6:
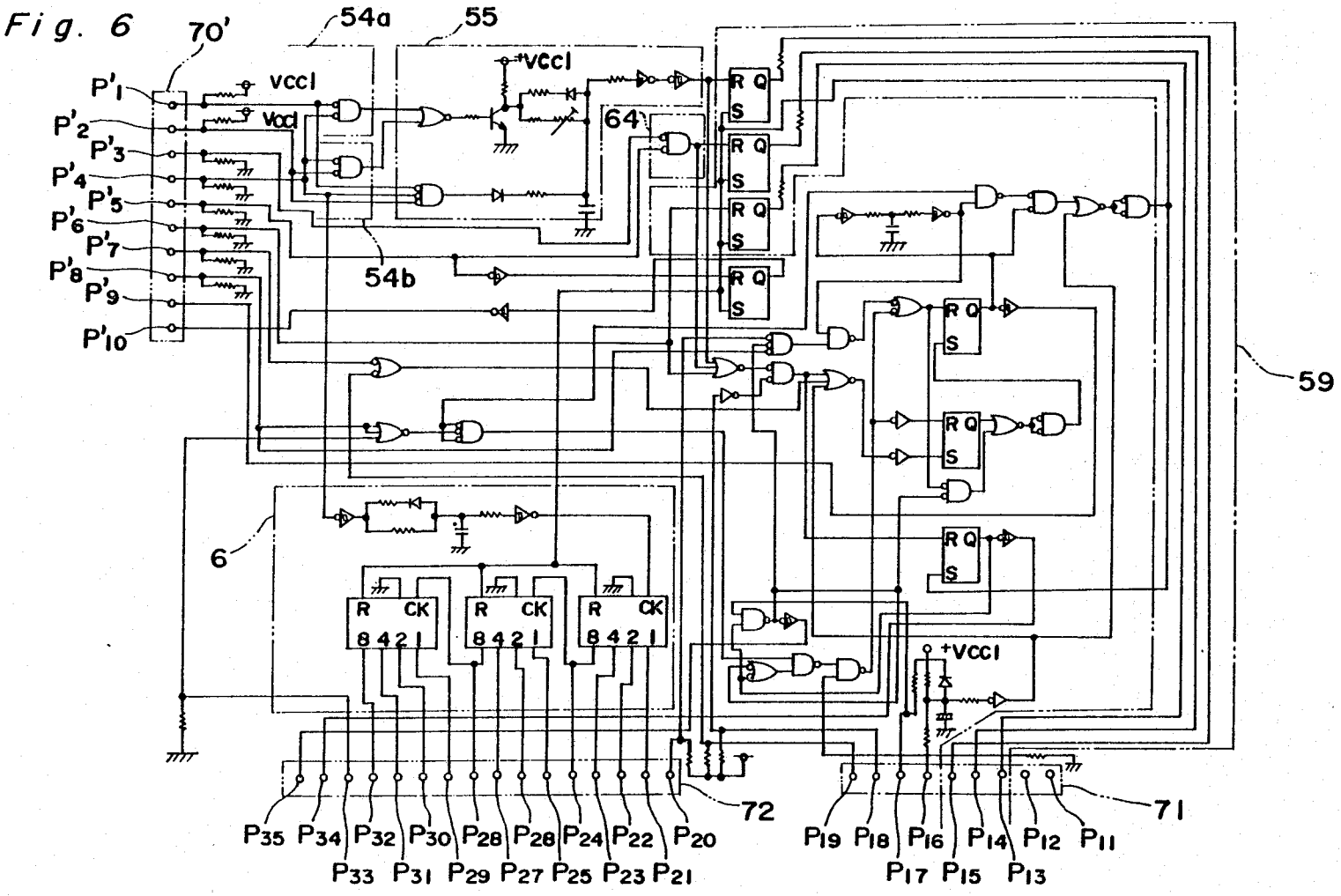
Figure 7:
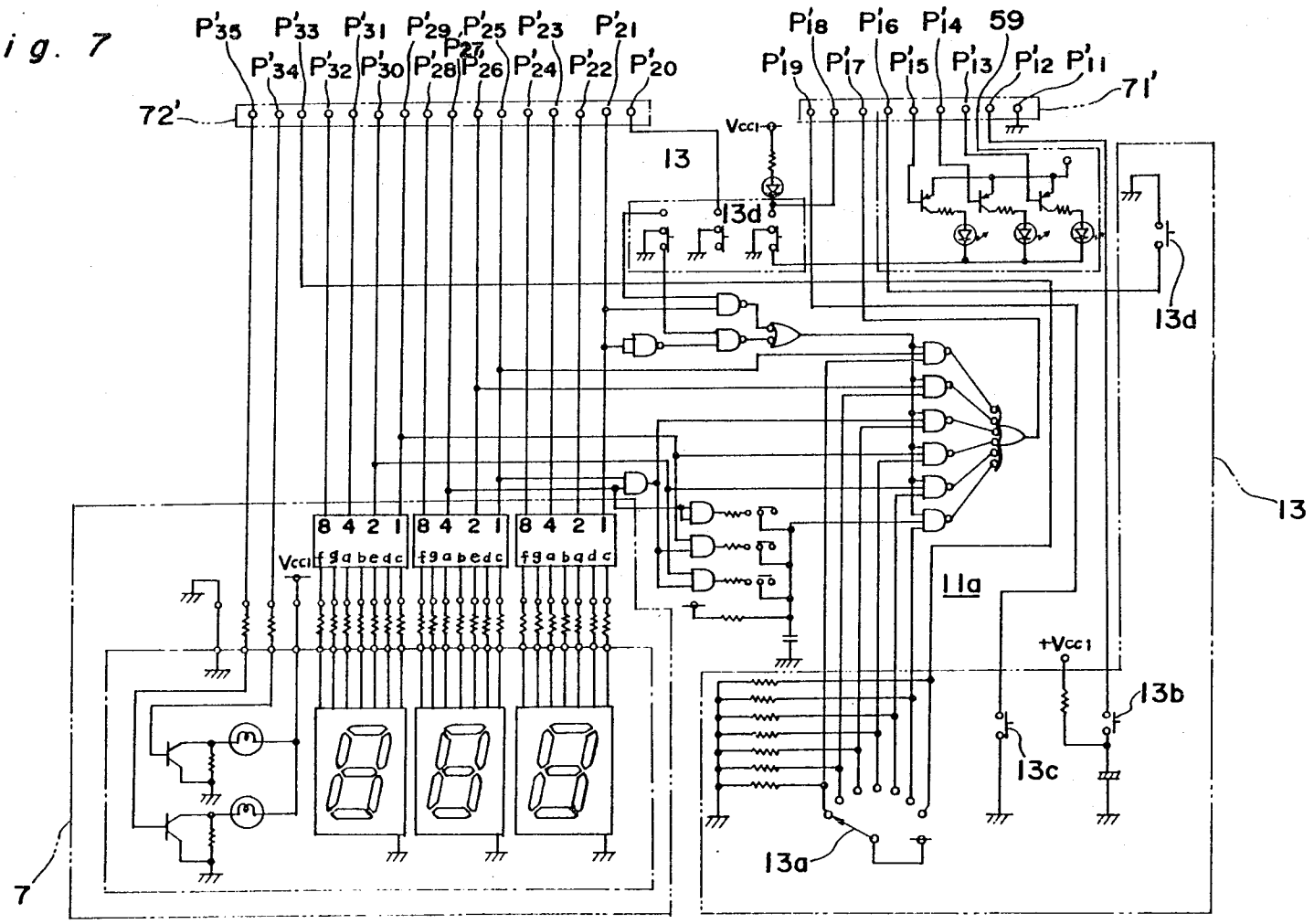

Then, the concrete circuit diagram of FIG. 4 is shown in FIG. 5, FIG. 6 and FIG. 7.

Referring to FIG. 5, FIG. 6 and FIG. 7, the circuit corresponding to each of the circuits of FIG. 4 is surrounded by a two-dot chain-line, wherein the same numerals as those given to each of the circuits of FIG. 4 are used.

The circuits, which are not surrounded by a two-dot chain line, in FIG. 5, FIG. 6 and FIG. 7 approximately correspond to the control circuit 11 of FIG. 4.

The circuit of FIG. 5 is connected to the circuit of FIG. 6 through the mutual connection between the terminals Pi (i=1, . . . , 10) of a connector 70 with the terminals P'i of a connector 70'. The circuit of FIG. 6 is connected to the circuit of FIG. 7 through the mutual connection between the terminals Pi (i=11, . . . , 19) of a connector 71 and the terminals P'i of a connector 71', and the mutual connection between the terminal Pi (i=20, . . . , 35) of a connector 72 and the terminals P'i of a connector 72'.

In FIG. 5, FIG. 6 and FIG. 7, $+Vcc_1$ is a DC power supply of 12 volts, $+Vcc_2$ is a DC power supply of 2.6 volts, and $+Vcc_3$ is a DC power supply of 24 volts.

The operation will be described hereinafter.

After many sheet materials 3 such as bill or the like to be counted have been piled up on the supply portion 31 of the feed mechanism 30 as shown in FIG. 4, the sheet-number setting switch 13a is set to 50 and start switch 13b is turned on the control circuit 11 judges whether or not the sheet material 3 already exists on the stacker portion 38 by the output of the phototransistor 46.

Figure 8:
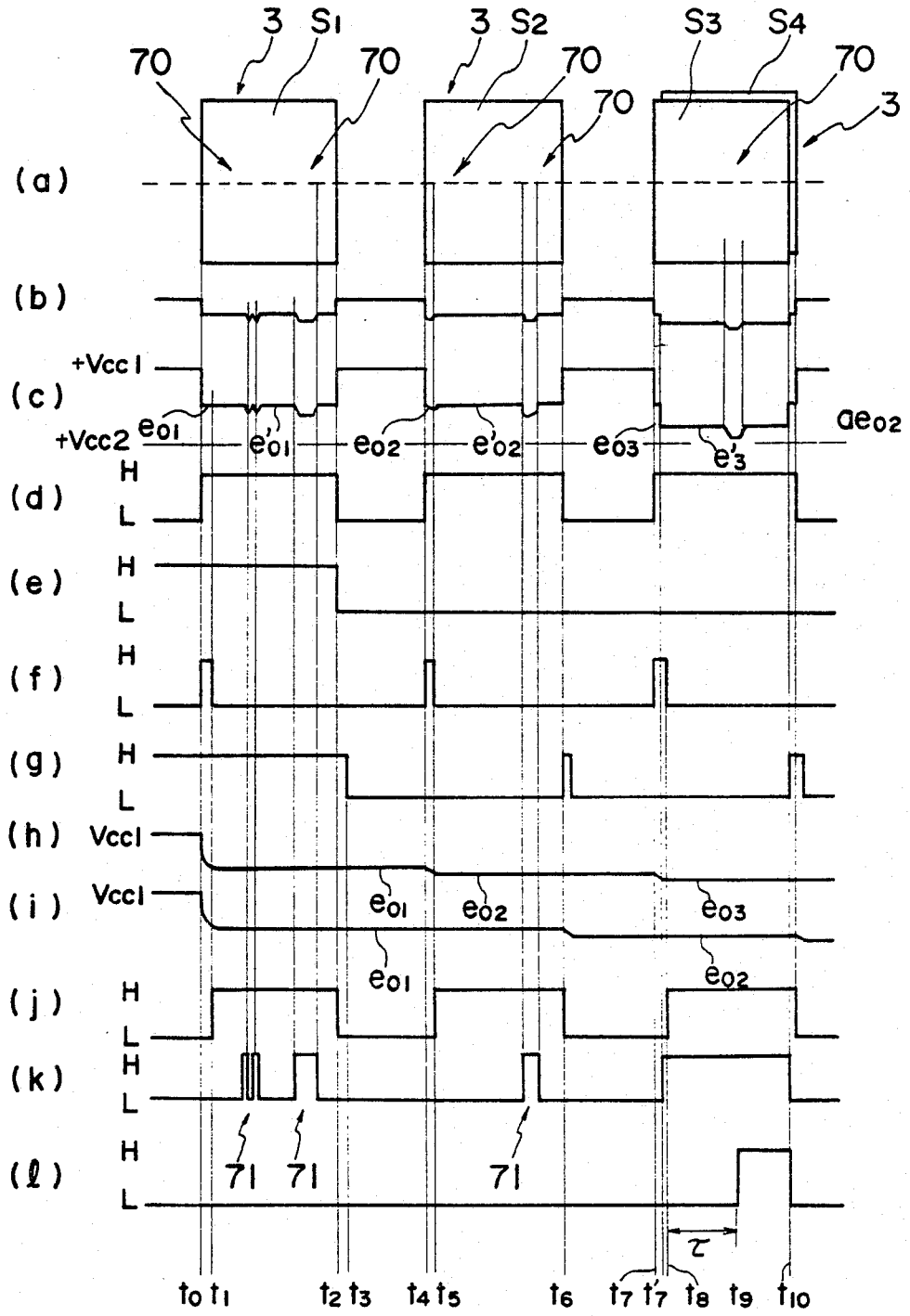
FIGS. 8(*a*) through 8(*l*) are time charts each showing the operation of each portion of a double-feed detection circuit of FIG. 4.

Assuming that no sheet materials 3 exist on the stacker portion 38 and the light of the light-emitting diode 47 is emitted to the phototransistor 46, the control circuit 11 delivers the sheet materials 3, piled up on the feed portion 31 of the feed mechanism 30, to operate the solenoid 39 of the driving circuit 12 and the electromagnetic clutch 31, to the stacker portion 38 through the passage 32 sequentially from the lowermost sheet material $S_1$ as shown in FIG. 8(*a*).

Then the leading edge of a first sheet material $S_1$ reaches at a time $t_0$, between the infrared-ray, emitting diodes 42, 43 and photodiodes 44, 45, such a photocurrent amount as shown in FIG. 8(*b*) is caused, in the photodiode 44, in accordance with the transmission amount of the infrared ray emitted from the infrared-ray emitting diode 42. The photocurrent is converted into such a voltage as shown in FIG. 8(*b*) by the amplification circuit 4 and is outputed to the double-feed detecting circuit 50.

The outputs of the photodiode 45 and the amplification circuit 5 become the same as shown in FIG. 8(*b*) and (*c*). The output of the amplification circuit 5 is outputted to the double-feed detecting circuit 50.

The double-feed detection circuit 50 and the length-illegality detection circuit 60 are operated as follows by the signals of the amplifying circuits 4 and 5. The operation of the double-feed detection circuit 50 will be described as follows.

1. when the signal from the amplification circuit 4 is inputted, the output of the level comparator circuit 51a rises, at the time $t_0$, from a L level to a H level as shown in FIG. 8(*d*). The sample pulse of a constant width (approximately 2 msec) is outputted, at the rising timing, to the memory circuit 56a from one-shot circuit of the timing circuit 52a as shown in FIG. 8(*f*).

Then the sample pulse is inputted, the memory circuit 56a sample-holds the output $e_{01}$ (see FIG. 8(*c*)) of the amplification 4 between the time $t_0$ and a time $t_1$ when the pulse falls as shown in FIG. 8(*h*).

The output $e_{01}$ corresponds to the transmission amount of the infrared ray which has been transmitted through such as the portion of the leading edge 2 mm or 5 mm of a first sheet material $S_1$.

At this time, a first-sheet signal as shown in FIG. 8(*e*) is inputted to the timing circuit 58 from a flip-flop provided on the control circuit 11, which is set by the action of the clear switch 13e, the start switch 13b or the like and is reset at a time $t_2$ when the output of the AND gate 65 falls at first.

The timing circuit 58 outputs, to the memory circuit 57a, a logical sum, as a sample pulse, between the first sheet signal and a pulse signal of given width to be outputted from the falling time point of the output (see FIG. 8(*d*)) of the level comparator circuit 51a as shown in FIG. 8(*g*), by the first sheet signal and the output of the AND gate 65.

When the first-sheet signal is outputted from the control circuit 11, the bilateral switch of the sample hold circuit constituting the memory circuit 57a is turned on from the time $t_0$ to a time $t_3$ where the sample pulse falls to a L level. The memory circuit 57a removes the output of the memory circuit 56a at the same time when the output $e_{01}$ of the amplification circuit 4 is sample-held by the memory circuit 56a as shown in FIG. 8(*e*).

The output ($=e_{01}$) of the memory circuit 57a is inputted to the comparison circuit 54a.

The gate for controlling the output is provided on the comparison circuit 52a. Since an output control pulse, which becomes a H level after 2 msec and becomes a L level due to the falling of the output (see FIG. 8(*d*)) of the AND gate 65 as shown in FIG. 8(*f*), is inputted from the timing circuit 58 to the gate, the comparison circuit 54a outputs, to a pulse width discrimination circuit 55, a signal showing the result of the comparison between the output $e'_{01}$ of the amplification circuit 4 between the time $t_1$ and the time $t_2'$ and the output ($=e_{01}$) of the memory circuit 57a as shown in FIG. 8(*k*).

When the sheet material $S_1$ is not broken, folded back or damaged, the level comparator 51b, the memory circuit 53b, the timing circuit 52 and the comparison circuit 54b perform the same operation as described hereinabove.

As apparent from FIG. 8(*k*), the comparison circuits 54a and 54b output pulses 71, 71, . . . because the infrared-ray transmission degree of the portion becomes low, when letters 70, 70, . . . etc. are printed on the sheet material $S_1$, to provide the relationship of $e'_{01}/e_{01} < k_1 < k_2$ wherein $k_1$, $k_2$ are constants in connection with the characteristics of comparison circuits 54a, 54b. As the widths of these pulses are sufficiently narrow respectively compared with the width of the sheet material $S_1$, the pulse width discrimination circuit 55 will not output a double-feed signals.

2. When the leading edge of a second sheet material $S_2$ reaches between the infrared-ray emitting diode 42 and the photodiode 44 at a time $t_4$ after a first sheet material $S_1$ has passed between the infrared-ray emitting diode 42 and the photodiode 44 as described hereinabove, the memory circuit 56*a* sample-holds (see FIG. 8(*c*) and (*h*)) the output $e_{02}$ of the amplification circuit 4 between a time $t_4$ and a time $t_5$ by a sample pulse to be inputted from the timing circuit 52*a* in the same manner as described hereinabove.

Since a first-sheet signal is not inputted to the timing circuit 58 at this time, the memory circuit 57*a* keeps storing the output $e_{01}$ as shown in FIG. 8(*i*).

Accordingly, the comparison circuit 54*a* outputs the compared result between the output $e'_{02}$ of the amplification circuit 4 and the output $e_{01}$ between a time $t_5$ and a time $t_6$ when the trailing edge of the sheet material $S_2$ passes between the infrared-ray photodiode 42 and the photodiode 44. However, as the first sheet material $S_1$ and the second sheet material $S_2$ are almost the same in property, the difference in infrared-ray transmission amount is hardly found therebetween the relationship of $k_1 < e'_{02}/e_{01} < k_2$ is established except for the printed portion of letters 70, 70, . . . , etc.

The level comparator circuit 51*b*, the timing circuit 52*b*, the memory circuit 53*b* and the comparison circuit 54*b* operate in the same manner as described hereinabove.

As apparent from the above-description, the pulse-width discriminating circuit 55 will not output the double-feed signal as in the case of the above-described 1.

When the output of the level comparator circuit 51*a* becomes a L level at a time $t_6$, a sample pulse is inputted (see FIG. 8 (*d*), (*g*)) from the timing circuit 58 to the memory circuit 57*a*, the output $e_{02}$ of the memory circuit 56*a* is moved to the memory circuit 57*a* and the memory circuit 56*a* get prepared for the next sample hold.

3. When the leading edge of the third sheet material $S_3$ reaches between the infrared-ray emitting diode 42 and the photodiode 44 at a time $t_7$, the memory circuit 56*a* sample-holds the output $e_{03}$ of the amplification circuit 4, in the same manner as described in the above-described 2, between the time $t_7$ and a time $t_8$ by a sample pulse shown in FIG. 8(*f*). As shown in FIG. 8(*a*), a fourth sheet material $S_4$ is piled upon the sheet material $S_3$. When the leading edge of a fourth sheet material $S_4$ reaches between the infrared-ray emitting diode 42 and the photodiode 44 at a time $t'_7$ slightly later than the time $t_7$, the transmission amount of the infrared ray is further reduced. The output of the amplification circuit 4 becomes considerably smaller than the $e_{02}$ as shown in FIG. 8(*c*).

Accordingly, the relationship of $e'_{03}/e_{02} < k_1 < k_2$ is established. The output of the comparison circuit 54*a* becomes a H level till a time $t_{10}$ when a third sheet material $S_3$ passes between the infrared-ray emitting diode 42 and the photodiode 44. A series of circuits from the level comparator circuit 51*b* to the comparison circuit 54*b* operate in the same manner as described hereinabove. The comparison circuit 54*b* outputs the similar signal to that of FIG. 8(*k*) is outputted to the pulse width discriminating circuit 55.

As a time when signals from the comparison circuit 54*a*, 54*b* are at a H level, exceeds 2, the output level of the integration circuit becomes larger than a predetermined reference level. As shown in FIG. 8(*l*), the signal becomes a H level at a time $t_9$. The pulse-width discriminating circuit 55 outputs a double feed signal to the illegality display circuit 59.

Thus, the illegality display circuit 59 displays the double feed and outputs an illegality signal to the control circuit 11 thereby to stop the feed mechanism 30.

The double feed of the sheet material 3 is adapted to be detected in a manner as described hereinabove. The sample pulse period of FIG. 8(*f*) is short in time from one hundred msec to several hundreds msce. Since the drifts of the infrared-ray emitting diodes 42, 43, photodiodes 44, 45, amplification circuits 4, 5, etc. can be almost neglected during this period, the ratio (generally the ratio between $e_{0n}$ and $e'_{0n+1}$) between $e_{01}$ and $e'_{02}$ on the first sheet material $S_1$ and the second sheet material $S_2$ becomes almost 1. Accordingly, error actions to be caused by the drifts, etc. can be completely prevented.

The operation of the length-illegality detecting circuit 60 will be described as follows.

1. First, the outputs from the sheet materials $S_1$ through $S_4$, outputs from photodiodes 44, 45, outputs of the amplification circuits 4, 5, outputs of the level comparators 51*a*, 51*b*, and a first-sheet signal are respectively shown again in FIG. 9(*a*) through (*e*).

Figure 9:
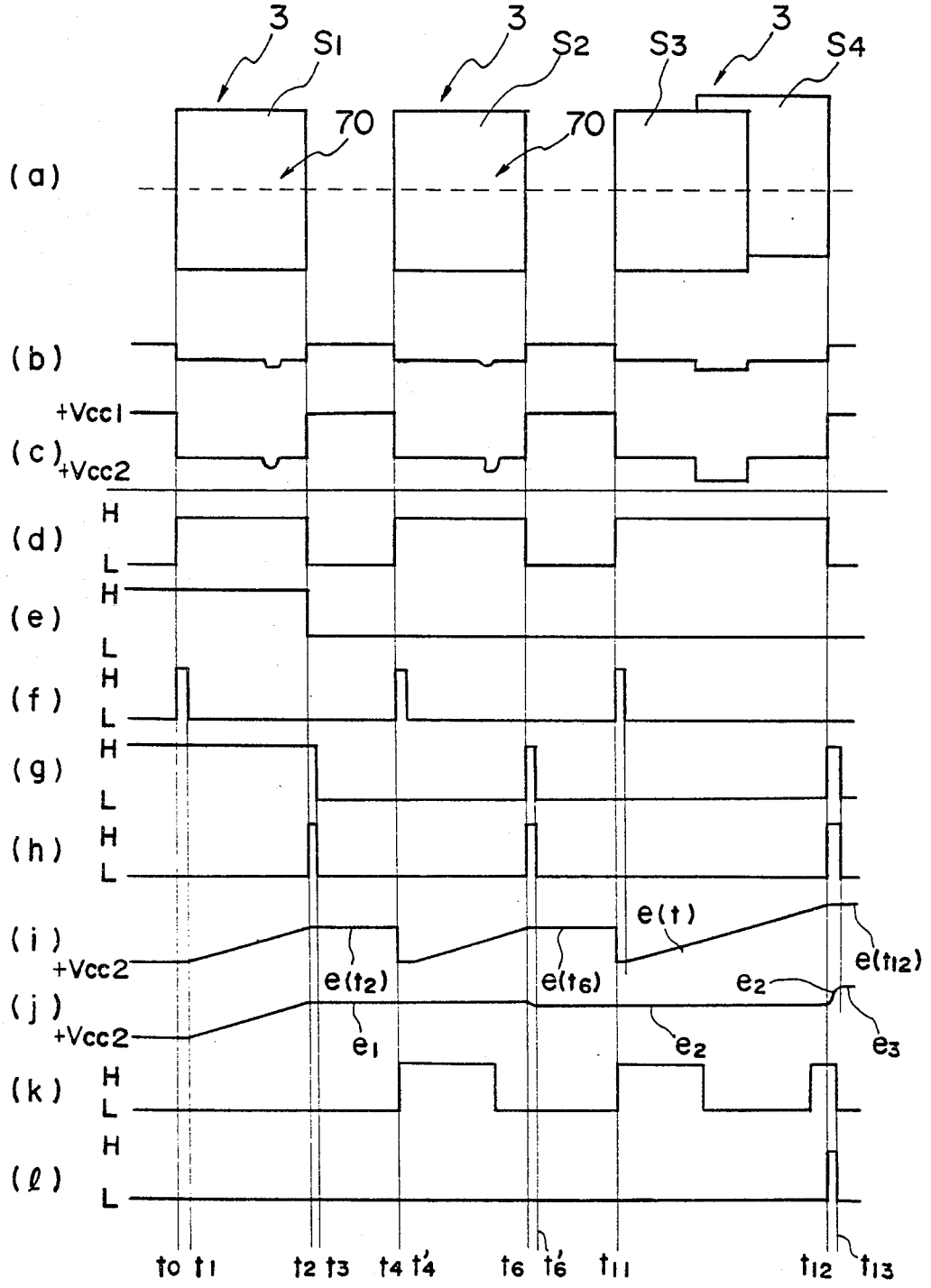
FIGS. 9(*a*) through 9(*l*) are time charts each showing the operation of each portion of a length-illegality detection circuit of FIG. 4.

When the leading edge of the first sheet material $S_1$ reaches between the infrared-ray emitting diodes 42, 43 and the photodiodes 44, 45 at a time $t_0$, such a timing pulse of a given width as shown in FIG. 9(*f*) is outputted from the timing circuit 58 to the T - V conversion circuit 61.

When the timing pulse is inputted, the T - V conversion circuit 61 discharges the electric charge of the integration capacitor and thereafter starts the integration of the output of the AND gate 65, as shown in FIG. 9(*i*), from the falling time $t_1$ of the timing pulse.

At this time, the same sample pulse as shown in FIG. 9(*g*) is outputted to the memory circuit 62, as shown in FIG. 9(*g*), from the timing circuit 58, and thus the output of the memory circuit 62 changes as shown in FIG. 9(*j*).

When the trailing edge of the sheet material $S_1$ passes between the infrared-ray emitting diodes 42, 43 and the photodiodes 44, 45 at a time $t_2$, the outputs of the level comparators 51*a*, 51*b* become a L level and the output of the AND gate 65 becomes a L level as shown in FIG. 9(*d*) to cut off the input of the T - V conversion circuit 61.

The output $e(t_2)$ of the T - V conversion circuit 61 at the time $t_2$ is sample-held as it is by the memory circuit 62 even after the time $t_3$ when the output pulse falls as shown in FIG. 9(*g*). The output $e_1(=e(t_2))$ of the memory circuit 62, together with the output $e(t_2)$, is inputted to the comparison circuit 63.

In this case, the relationship of $e_2 = e(t_2)$ is established. The output of the comparison circuit 63 to be outputted from the gate circuit 64, which is opened by the control pulse of FIG. 9(*h*) to be inputted from the timing circuit 58, with the relationship of $k'_1 < e(t_2)/e_1 < k'_2$, wherein $k'_1$, $k'_2$ are constants established by the comparison circuit 63 is at a L level as shown in FIG. 9(*l*).

2. The same operation as described hereinabove is effected, at times $t_4$, $t_4$, $t_6$, $t_6$, for the second sheet material $S_2$.

Since the integration capacitor of the memory circuit 62 is discharged at a time $t_4$, a time period when the relationship of $e(t)/e_1 < k'_1$ is provided is caused. The output of the camparison circuit 63 becomes a H level as shown in FIG. 9(*k*). However, since the gate circuit 64 is closed in this period, the length illegality signal is not outputted.

3. When a third sheet material $S_3$ and a fourth sheet material $S_4$ have been linkingly fed, as shown in FIG. 9(*a*), between a time $t_{11}$ through a time $t_{12}$, the passing time ($=t_{12}-t_{11}$) of the sheet materials 3, 4 becomes a value twice as much as the sheet material $S_1$ or the sheet material $S_2$. Thus, the output $e(t_{12})$ in the time $t_{12}$ of the T - V conversion circuit 61 becomes to satisfy the relationship $e(t_{12}) \geq e(t_6)(=e_2)$ as shown in FIG. 9(*e*).

Accordingly, when the sample-hold pulse (see FIG. 9(*g*) is inputted at the time $t_{12}$, the output of the memory circuit 62 rises like $e'_2$ from $e_2$ to $e_3$ ($=e(t_{12})$) as shown in FIG. 9(*j*). Assume that the relationship of $e(t_{12})/e'_2 < k'_2$ is established at a time $t_{13}$, and the output of the comparison circuit 63 becomes a H level till the time $t_{13}$.

At this time, since a control pulse is inputted to the gate circuit 64 as shown in FIG. 9(*h*), the gate circuit 64 is open to output the length illegality signal (see FIG. 9(*j*)), which has a pulse width of the ($t_{13}-t_{12}$), to the illegality display circuit 59.

When the length illegality signal is inputted, the illegality display circuit 59 displays the length illegality and outputs an illegal signal to the control circuit 11 to stop the feed mechanism 30.

With the length illegality detection circuit 60 of such character as described hereinabove, the difference in the feed speed of the mechanism 30 can be hardly formed between the first sheet material $S_1$ and the second sheet material $S_2$, as generally obtained between the sheet material $S_n$ of n th and sheet material $S_{n+1}$ of n+1st sheet. The output of the memory circuit 62 is adapted to make the relationship of $k'_1 \leqq e_2/e_1 \leqq k'_2$ while making of $k'_1 \leqq e_{n+1}/e_n \leqq k'_2$. So long as the feed speed or the like does not change abruptly, the length-illegality detection circuit 60 does not perform the error action.

Figure 10:
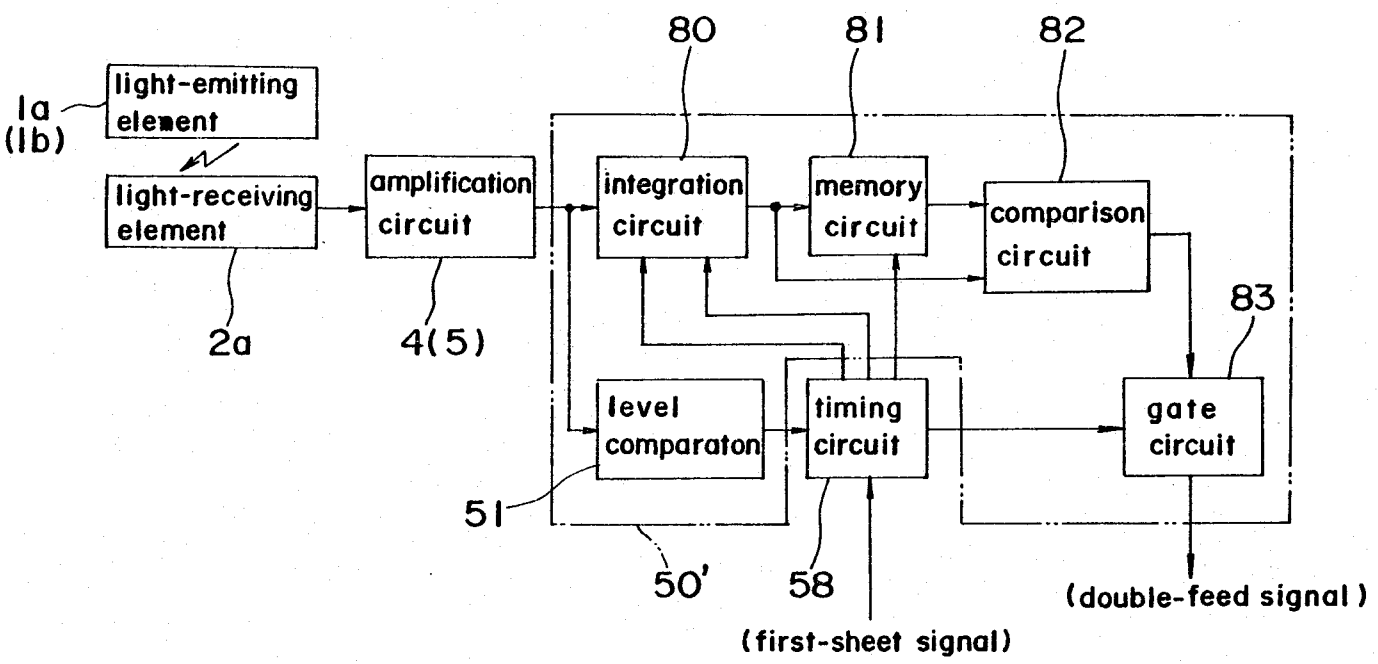
FIG. 10 is a block diagram of a modified example of the double-feed detection circuit of FIG. 4.
Figure 11:
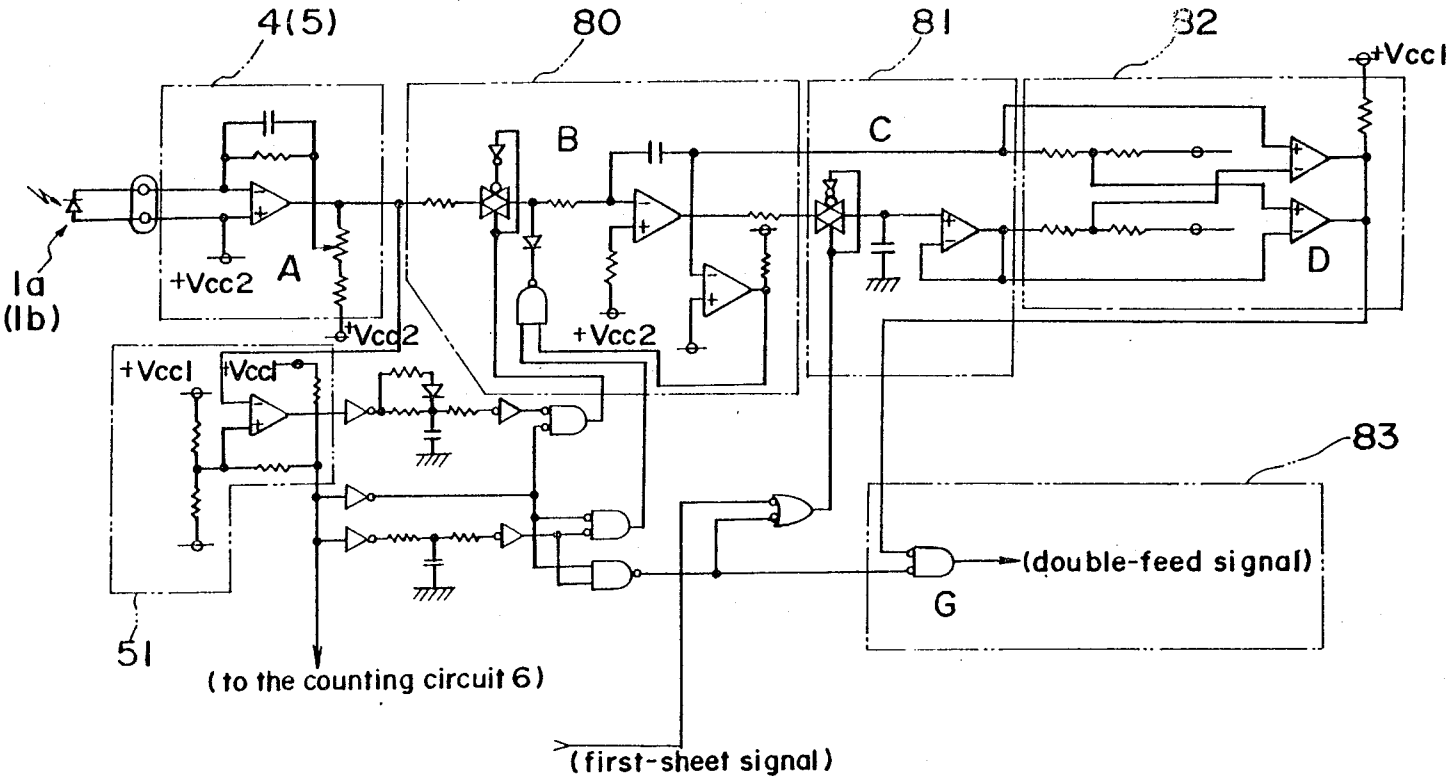
FIG. 11 is a circuit diagram of FIG. 10.
Figure 12:
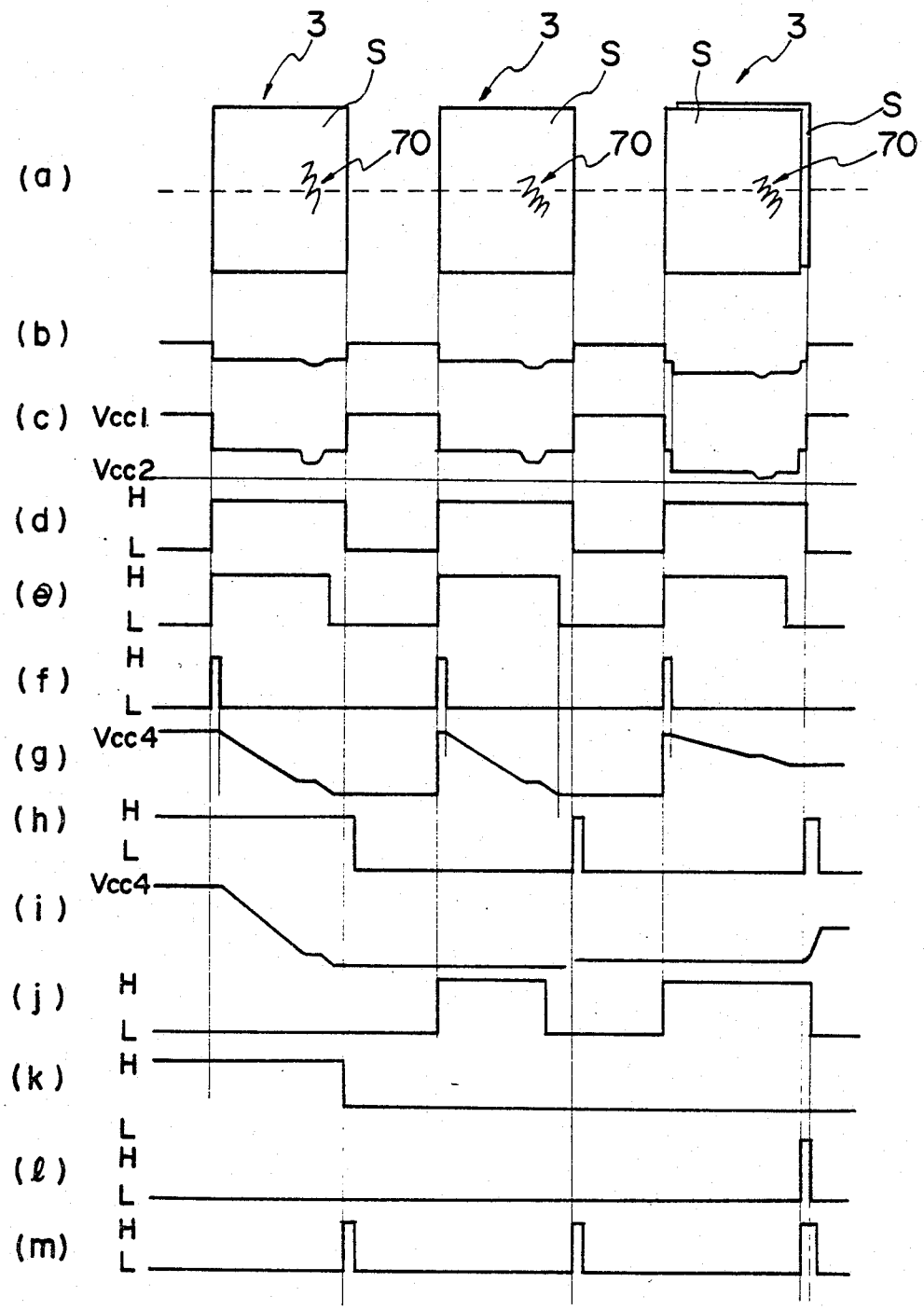
FIGS. 12(*a*) through (*m*) are time charts each showing the operation of each portion of FIG. 10.

Instead of the double-feed detecting circuit 50 of FIG. 4, the output of the amplification circuit 4(5) shown in FIG. 12(*c*) is inputted to an integration circuit 80 for integrating operation as shown by a block diagram and a concrete circuit diagram, respectively, in FIG. 10 and FIG. 11. The output (see FIG. 12(*g*)) is inputted to the memory circuit 81 for sample-holding operation, the output (see FIG. 12(*i*)) is compared with the output of the integration circuit 80 by a comparison circuit 82, the double feed signal may be outputted, as shown in FIG. 12(*l*) , from a gate circuit 83, which opens by a control pulse (see FIG. 12(*m*)) to be outputted from the timing circuit 58.

Since the integration value of the transmission value of the infrared-ray obtained across a given length width with respect to the feed direction of the sheet material in the double feed detecting circuit 50', more preferable result can be obtained when the sheet material, with many printed portions thereon, such as bill, etc. are counted.

In time charges shown respectively in FIGS. 12(*a*) through (*m*), FIGS. 12(*a*), (*b*), (*c*) and (*d*) are respectively the same as FIGS. 8(*a*), (*b*), (*c*) and (*d*) FIGS. 12(*e*) is a pulse, which specifies an integration period to be inputted to the integration circuit 80 from the timing circuit 58. FIG. 12(*f*) is a reset pulse of the integration circuit 80. FIG. 12(*h*) is a sample pulse to be inputted to the memory circuit 81. FIG. 12(*j*) is an output of the comparison circuit 82. FIG. 12(*k*) is a first-sheet signal.

Also, the wave form charts of FIGS. 8(*a*) through (*l*), FIGS. 9(*a*) through (*l*) and FIGS. 21(*a*) through (*m*), etc. are represented by positive logic to simplify the illustration. The positive logic and the negative logic are used in common in the actual circuits of FIG. 5, FIG. 6 and FIG. 7, and the above-described wave form charts do not represent the output wave forms of the corresponding circuits of the actual circuit diagrams.

The present invention is not restricted to the above-described embodiment. The present invention can be applied not only to the counter apparatus of the sheet materials, but also to a progressive operating apparatus for printing paper in a printing press.

The comparison circuits 54*a*, 54*b*, 63, etc. may decide whether or not the absolute value of the difference between both inputs stays within a given range, instead of deciding whether or not the ratio of the both input signals stays within a given range.

As apparent from the detailed description, the present invention uses an electric showing the property of the optional portion of the n th sheet material as a reference value of the comparison between an electric signal showing the property of the (n+) first sheet material and the electric signal showng the property of the optional portion of the n th sheet material. The size of the difference, between both electric signals, exceeded the predetermined range is detected to detect the illegality of the sheet material. So long as the sheet materials having almost the same property are counted, the lag of the electric signal showing the property of the (n+) first sheet material with respect to the reference value determined by the n th sheet material can be almost neglected. Thus, the double-feed detection circuit and the length-illegality detecting circuit do not perform the error actions by the drifts of the various circuits or variation in the feed speed of the sheet materials. In addition, since the drifts or the like of the various circuits do not matter as described hereinabove, inexpensive circuit components can be used. Also, as the drifts do not matter, the infrared-ray emitting diode, which could not be used before as a light source, can be used, the service life of the light source can be rendered longer and the consumption power can be rendered less.

Although the present invention has been described and illustrated in detail, it is to be clearly understood that the same is by way of illustration and example only and is not to be taken by way of limitation, the spirit and scope of the present invention being limited only by the terms of the appended claims.

What is claimed is:

1. An abnormal sheet material detecting apparatus for use in a sheet material processing machine which is adapted to pass at intervals a given portion of every single sheet of material and to pick up the sheets, one by one, from a plurality of sheet materials, each one having approximately the same property, comprising:

a detecting circuit including a sensor for detecting a predetermined portion of a single sheet material at a given position in accordance with the amount of light transmitted through said single sheet material, with said amount of light being a variable value from sheet to sheet;

a first memory circuit for storing, in sequence, the detected value of each of said variable value of transmitted amount of light with respect to each of said single sheet material output from said detecting circuit and for outputting a representative signal;

a second memory circuit for storing an output signal from said first memory circuit after at least said single sheet material is passed through said sensor provided within said detecting circuit for detecting the transmitted amount of light;

a comparison circuit for outputting signals, each corresponding to the difference between said detected and memorized value of said transmitted amount of light with respect to the nth (n being an integer of 1 or more) single sheet material stored within said second memory circuit and said detected and variable value for said transmitted amount of light with respect to the n+1th single sheet material, said output signal provided when the detecting circuit determines a difference beyond a predetermined upper and lower limit; and a discrimination circuit for outputting an abnormal condition detecting signal when said output signal of said comparison circuit is continued beyond a predetermined time period.

2. The detecting apparatus of claim 1 wherein said detecting circuit includes first and second transducer means disposed at separate locations for detecting properties of said sheet material at separate locations of said sheet, said detecting circuit being arranged to generate first and second property signals.

3. The detecting apparatus of claim 1 wherein said first and second storage circuits are respectively coupled to one of said first and second transducer means.

4. The detecting apparatus of claim 3 wherein said comparison circuit comprises first and second comparison circuits, one each coupled to said first and second transducer means and to said first and second storage means.

5. The detecting apparatus of claim 1 wherein said detecting circuit is adapted to generate a property signal representative of the thickness of such sheets.

6. The detecting apparatus of claim 1 wherein said detecting circuit is adapted to generate a property signal representative of the length of such sheets.

7. The detecting apparatus of claim 1 wherein the detection circuit is a size detection circuit for converting the size of the predetermined portion of the sheet material into an electric signal proportional to the size of said sheet.

8. An illegal-sheet-material detection apparatus for detecting the existence of a condition wherein a property of a sheet, which varies in value from sheet to sheet, exceeds a predetermined nominal range, comprising:

detecting means for detecting such property of each of such sheets as a particular position and generating a property signal representative of such property, which property signal will also vary from sheet to sheet;

first and second memory means coupled to said detecting means for memorizing, respectively, the variable value signal level of the n+1 sheet, wherein n is an integer of one or more; and comparing means coupled to said detecting means and said memory means for comparing the detected value of the variable property signal for the nth+1 sheet with respect to the memorized value of the property signal for the nth sheet, where n is an integer of 1 or more, and generating an illegality signal when the ratio of said property value signals for said nth+1 and nth sheets exceeds a predetermined range.

9. The detection apparatus of claim 8 wherein said detecting means includes first and second transducer means disposed at separate locations for detecting such property at separate locations of said sheet and arranged to generate first and second property signal, respectively.

10. The detection apparatus of claim 9 wherein said memory means includes first and second memory units, one each coupled to one of said first and second transducer means.

11. The detection apparatus of claim 10 wherein said comparison means comprises first and second comparison circuits, one each coupled to said first and second transducer means and to said first and second memory means.

12. The detection apparatus of claim 11 wherein said comparison means further comprises discriminating means coupled respectively to said first and second comparison circuits, and said comparing means is adapted to generate said illegality detection signal when the output of one of said comparing means exceeds said predetermined range for at least a predetermined time interval.

13. The detection apparatus of claim 12 wherein said detecting means is adapted to generate a property signal representative of the thickness of such sheets.

14. The detection apparatus of claim 12 wherein said detecting means is adapted to generate a property signal representative of the length of such sheets.

* * * * *